US007946205B2

(12) United States Patent
Benvenuti et al.

(10) Patent No.: US 7,946,205 B2
(45) Date of Patent: May 24, 2011

(54) DEVICE AND METHOD FOR ELIMINATING TRIMMINGS FROM SERIES OF PRODUCTS, SUCH AS ROLLS OR THE LIKE

(75) Inventors: Angelo Benvenuti, Lucca (IT); Mario Gioni Chiocchetti, Lucca (IT); Mauro Gelli, Lucca (IT)

(73) Assignee: Fabio Perini S.p.A., Lucca (IT)

( * ) Notice: Subject to any disclaimer, the term of this patent is extended or adjusted under 35 U.S.C. 154(b) by 401 days.

(21) Appl. No.: 10/541,874

(22) PCT Filed: Dec. 9, 2004

(86) PCT No.: PCT/IT2004/000682

§ 371 (c)(1),
(2), (4) Date: Jul. 11, 2005

(87) PCT Pub. No.: WO2005/056255

PCT Pub. Date: Jun. 23, 2005

(65) Prior Publication Data

US 2006/0124435 A1 Jun. 15, 2006

(51) Int. Cl.
*B26D 3/16* (2006.01)
*B26D 7/18* (2006.01)

(52) U.S. Cl. ..... 83/104; 83/102; 83/151; 83/167

(58) Field of Classification Search ..... 83/102, 83/104, 151–155.1, 89, 409, 149, 167; 209/617, 209/912; 198/803.7, 803.9, 377.07, 377.03, 198/470.1, 471.1, 460.1
See application file for complete search history.

(56) References Cited

U.S. PATENT DOCUMENTS 4,033,862 A * 7/1977 Spencer ..... 209/617
4,265,361 A 5/1981 Schroeder
4,462,287 A * 7/1984 Weis et al. ..... 83/104
4,977,803 A * 12/1990 Blom ..... 83/23
(Continued)

FOREIGN PATENT DOCUMENTS

EP 0668132 A1 * 8/1995
(Continued)

OTHER PUBLICATIONS

Kawanoe Zoki KK, Patent Abstracts of Japan, vol. 18, No. 217, Apr. 19, 1996 and JP 06-015599 A, Jan. 25, 1994.

*Primary Examiner* — Laura M. Lee
(74) *Attorney, Agent, or Firm* — Breiner & Breiner, L.L.C.

(57) ABSTRACT

The device comprises at least a continuous movable flexible member (23) carrying a series of contact members (29, 29A, 29B) for the products (R; R1; RN) aligned with one another. A section of the movable flexible member is devoid of said contact members to allow the trimmings (Rc, Rt) to fall. At least a longitudinal supporting element (21) of the products (R; R1, RN), is also provided, parallel to the movable flexible member, the reciprocal position of said flexible member and of said longitudinal element being such that the products advance in contact with the contact members (29, 29A, 29B) of the flexible member and with the longitudinal element. A pusher (11) inserts the series of products with the respective trimmings between the flexible member and the longitudinal supporting member. The flexible member (23) is controlled with a variable speed to carry the section thereof devoid of contact members time by time to the level of the head and tail trimmings (Rc; Rt) of two consecutive series of products.

30 Claims, 9 Drawing Sheets

U.S. PATENT DOCUMENTS

| | | | | |
|---|---|---|---|---|
| 5,458,033 | A | 10/1995 | Wierschke | |
| 5,475,917 | A * | 12/1995 | Biagiotti | 29/822 |
| 6,332,527 | B1 * | 12/2001 | Wierschke | 198/369.7 |
| 2001/0022285 | A1 * | 9/2001 | Gambini | 209/698 |
| 2003/0015077 | A1 * | 1/2003 | Betti et al. | 83/100 |
| 2003/0167887 | A1 * | 9/2003 | Butterworth | 83/27 |
| 2004/0020343 | A1 * | 2/2004 | Gambini | 83/869 |

FOREIGN PATENT DOCUMENTS

| | | | |
|---|---|---|---|
| EP | 0 607 761 | B1 | 6/1997 |
| EP | 1231320 | A2 * | 8/2002 |
| GB | 2 137 918 | A | 10/1984 |
| IT | 01292359 | | 1/1999 |
| WO | WO 97/32804 | | 9/1997 |
| WO | WO 01/62635 | A1 | 8/2001 |

* cited by examiner

DEVICE AND METHOD FOR ELIMINATING TRIMMINGS FROM SERIES OF PRODUCTS, SUCH AS ROLLS OR THE LIKE

TECHNICAL FIELD

The invention relates to a device to remove scraps or end trimmings in the production of rolls of wound web material, such as paper or the like, for example to produce rolls of toilet tissue, kitchen towels or the like, produced by cutting longer rolls, or "logs", into several parts.

More generally, the present invention relates to a device to eliminate trimmings or scraps from series or rows of products.

STATE OF THE ART

The production of rolls of wound web material, such as toilet tissue, kitchen towels and the like, is performed by cutting a log, that is, an original roll with a diameter the same as the final rolls but of a much greater length than rolls destined for use, into several parts. The log is then cut into several parts by cutting machines, in order to obtain rolls of the desired length. During this operation head and tail trimmings or scraps are produced at both ends of the log, to discard the portion of edge material which is often damaged and in any case wound irregularly. By cutting the trimmings, rolls of the desired axial length are also obtained, even when the width of the initial web material is not an exact multiple of the height of the rolls.

These scraps or trimmings must be eliminated from the production line prior to packaging or wrapping, to be recovered by recycling the material if necessary, preventing clogging of wrapping machines.

Various machines have been developed to eliminate these scraps. Some machines use a procedure which makes use of pneumatic suction devices to hold the rolls while the trimmings are made to fall. Systems of this type are described in EP-A-607761 and in U.S. Pat. No. 5,458,033. In these known devices a conveyor with suction belt engages the rolls from above while the trimmings are not held by the belt conveyor and fall as a result of gravity to an area between a feed conveyor and a delivery conveyor of the rolls.

WO-A-0162635 describes a further device to eliminate trimmings based on the use of a flexible suction member which holds the rolls from above and makes them advance through the device, while areas devoid of suction of the flexible member are positioned at the level of the head and tail trimmings of each series of rolls.

GB-A-2137918 describes a device to eliminate trimmings from series of rolls obtained by cutting a log, comprising a continuous movable flexible member with a series of contact members for the products aligned with one another. A section of said movable flexible member is devoid of contact members to allow the trimmings to fall. This flexible member extends parallel to a smooth belt, movable at the same speed as the advance speed of the flexible member. This belt constitutes a longitudinal supporting element for the products. The products travel in contact with the contact members of the flexible member and with the smooth belt. The rolls and the trimmings are pushed along the path defined by the flexible member with the contact members and by the smooth belt by means of a series of pushers integral with a chain or belt conveyor disposed upstream of the device to eliminate trimmings. The trimmings are eliminated thanks to the fact that in the area in which the continuous flexible member is devoid of contact or supporting members, the trimmings have no support and fall as a result of gravity. The flexible member provided with contact members to support the rolls and to make the trimmings fall, must extend for a length equal to the length of the logs increased by the distance between consecutive logs. The device is therefore extremely bulky and cannot be adapted for products with different lengths.

This device is particularly efficient but not easily adaptable to the different dimensions of the rolls and of the logs to be handled.

Another system to eliminate trimmings is described in U.S. Pat. No. 4,265,361, in which all rolls of a size sufficiently small to escape from a series of engaging members positioned at a congruous distance are allowed to fall from the line.

WO-A-9732804 describes a system to eliminate head and tail scraps or trimmings based essentially on the roll conveying line being formed of three different sections. The first section is characterized by the presence of a pusher which pushes the rolls fed from the cutting machine along a guide or channel. The second section is characterized by the simultaneous presence of two motorized conveyor belts disposed under the path of the rolls. These provide support and transport for the rolls. The pusher is also present in this second section, and although it does not transport the rolls, which are transported by the two belts, it travels along part of this second section before being drawn back by the chain with which it is integral. The two belts of the second section of the path of the rolls are of different lengths and a bar forming a fixed support is positioned adjacent to the shorter belt. The bar is at a greater height than the two belts, one of which extends parallel to the bar. The trimmings are discarded in this third section.

IT-B-01292359 describes a system to eliminate head and tail trimmings from rows of cut rolls, which is based on the difference between the axial dimension of a roll destined for packaging and the axial dimension of a trimming. The rolls and trimmings are disposed on a conveyor line constituted by two parallel belt means, positioned at adjustable distances from each other, advancing in the same direction and at the same speed. The reciprocal distance of the two belt means is equivalent to the axial dimension of the rolls and therefore is greater than the axial dimension of the trimmings.

The trimmings are therefore eliminated owing to the fact that the reduced axial dimensions of the trimmings prevent simultaneous contact with both belts, so that the lack of support consequently causes the trimmings to fall from the lower belt. In order to operate, the device requires both the rolls and the trimmings to be fed into the path defined by the two overlapping belts, to be overturned and hence to lie on one of their flat faces. The device cannot function if the rolls and trimmings (or at least the latter) are fed in the position in which they are delivered from the cutting machine, that is, with their axis parallel to the feed path and hence parallel to the two belts. Therefore, upstream the device requires a system to overturn the rolls and trimmings, or at least the trimmings.

Similar problems may occur in other situations in which it is necessary to eliminate trimmings or scraps from series or rows of products obtained from cutting a semi-finished product of larger dimensions, or even simply from series of articles or manufactured products advancing along a processing line.

OBJECTS AND SUMMARY OF THE INVENTION

The object of the present invention is to provide a device to remove scraps or head and tail trimmings in series of aligned rolls, which is simple and reliable also at high operating speeds, with limited dimensions and which can also be easily adapted for different diameters and axial dimensions of cut rolls and for series containing a variable number of rolls.

More generally, the object of the present invention is to provide a device to eliminate scraps or trimmings from rows or series of articles or products advancing along a processing line, such as in particular (although not exclusively) series of rolls obtained by cutting logs.

According to a different aspect, the object of the invention is to offer an effective and reliable method to eliminate head and tail trimmings from series of products, in particular series of rolls obtained by cutting logs crosswise.

The device according to the invention comprises a conveyor or flexible member provided with contact or supporting elements or members, which support the products, and a longitudinal supporting element, extending parallel to a branch of the flexible member, wherein characteristically the flexible member is controlled at a variable speed and the longitudinal supporting element is preferably fixed.

With this configuration, contrary to the arrangement in, for example, GB-A-2137918, the device can easily be adapted to series of products of variable lengths and to products of variable dimensions without the need to adjust the mechanical configuration of the members thereof and hence without adaptations. In fact, as shall be apparent from the description of an example of embodiment, only the advance speed of the flexible member requires to be adjusted. The flexible member with controllable speed can be phased suitably to carry the section devoid of contact members to the level of the position of the head and tail trimmings of consecutive series of products. When the length of the series of products changes, and/or the distance between one series and the next changes, by setting a cyclic variation of the advance speed of the flexible member the area thereof devoid of contact members for the products to be handled can be phased in relation to the position of the head and tail trimmings of each series. In general, the flexible member can also be much shorter in length than the series of products (for example series of rolls cut from a log), with an advantage in terms of overall dimensions of the device, as well as advantages of greater flexibility and easy adaptability to the various product dimensions.

According to a possible configuration, forming an object of the invention, the device can be of the type comprising: at least a continuous movable flexible member carrying a series of contact members for the products aligned with one another, a section of said movable flexible member being devoid of said contact members to allow trimmings to fall; at least a longitudinal element to support the products, parallel to said movable flexible member, the reciprocal position of said flexible member and of said longitudinal element being such that the products advance in contact with the contact members of the flexible member and with the longitudinal element; at least a pusher to insert the series of products with respective trimmings between said flexible member and said longitudinal supporting element. Characteristically, the flexible member is controlled with a variable speed to carry the section thereof devoid of contact members time by time to the level of the tail and head trimmings of two consecutive series of products. The supporting element is preferably fixed and the products run thereon. This simplifies the structure and increases the reliability of the device.

In an advantageous embodiment, the continuous flexible member has at least a first contact member designed to grasp at least the last product of each series and make it advance. Preferably, it is also provided with at least a second contact member designed to grasp at least the first product of each series and make it advance. The intermediate contact members, not specifically designed to grasp the end products of each series, are advantageously and preferably produced with a product contact having a low friction coefficient, to allow said products to slide with respect to said supporting members.

The flexible member can advantageously be controlled at a variable speed to accelerate at least the last product of each series with respect to the pusher therebehind. Moreover, according to an improved embodiment of the invention, the flexible member can be controlled at a variable speed to accelerate and, if necessary, subsequently decelerate at least the first product of each series with respect to the subsequent product.

To produce a compact device, the flexible member can be controlled to advance at a lower speed or to stop during an interval of time between arrival of the first product and arrival of the last product of each series, the products being pushed by the pusher and sliding along the flexible member resting on the supporting member during said interval of time.

Advantageously, at least one of said contact members can be operated to have an grasping action on the products in contact therewith, for example by being pressed against the product with which it is in contact. For example and in particular, the engaging element provided with this capacity is the last engaging element disposed along the flexible member, that is, the one which engages the last product of each series of products, such as the last roll of a row of rolls obtained by cutting a log, ahead of the tail trimming.

In this way, the last roll can be accelerated in a reliable way to distance it from the tail trimming and also from the pusher which pushes the row or series of rolls or other products along the device. This on the one hand guarantees that the tail trimming is devoid of support in front and behind and therefore falls from the longitudinal supporting element, and on the other distances the rolls from the pusher, which can turn about the return wheel of the chain or belt on which it is mounted to return and engage a subsequent series of products, without interfering with the products of the series already inserted by said pusher in the device to eliminate trimmings. Preferably, at least two or more adjacent contact members are equipped to have an grasping action on the last product or roll of the series. This guarantees a safer hold and therefore improved control of the movement to accelerate the rolls.

In a preferred embodiment of the invention, the first contact member or members of the series of contact members carried by the flexible member can also be operated to grasp the products using pressure. This or these further contact members are destined to cooperate with the first product of each row or series, that is, with the product directly behind the head trimming. The grasping action on this roll allows it to be accelerated and, if necessary, subsequently decelerated, giving a sort of thrust or impact to the head trimming which, devoid of the support of the contact members will be overturned and fall, thus being eliminated.

For example, the contact members which can be operated to grasp the products can be mounted movable, with respect to the flexible member on which they are carried, at least in a direction essentially orthogonal to said flexible member. Or instead, each of these members can have an element movable with respect thereto. In both cases the contact member or movable element thereof can be moved to press against the product it must grasp, moving towards the longitudinal supporting element.

In a particularly advantageous embodiment of the invention, the contact members destined to have an grasping action on the rolls can have a movable portion or element, on which a fixed control profile acts, an elastic element being provided to hold said movable portion in contact with said fixed control profile.

In this way, while the flexible member advances along the control profile, the contact members, equipped with the movable portion operated by the control profile cooperate like a feeler with the control profile, which acts as a cam on the movable portion, pushing it against the product to be grasped. The control profile can have a length limited to the section of path along which it is necessary to grasp the rolls. This configuration is particularly advantageous, as grasping of rolls by the supporting members is obtained without the need for actuator elements, but thanks to the simple movement of the flexible member which carries the contact members and the fixed shaped profile, which acts as a cam. However, it would also be possible to use different systems, for example by providing the various contact members destined to grasp the rolls with specific actuator means, although this results in further complication, also due to the need to supply power to these members while they are moving.

In a particularly advantageous embodiment of the invention, the flexible member and the fixed longitudinal element are approximately vertically overlapped with each other, with the fixed longitudinal supporting element under the flexible member.

To allow the pusher to enter the path defined by the flexible member and by the fixed longitudinal supporting element without interfering with these components, in an advantageous embodiment the pusher has a slot inside which the fixed longitudinal element penetrates when said pusher pushes the products between the fixed longitudinal element and the flexible member. This allows a particularly simple and compact device to be obtained, without the need to provide further belts or other members for roll handling.

The contact members carried by the flexible member can advantageously have a contact surface for the products to be handled having a low friction coefficient, to allow sliding of the products grasped by said contact members. In this way the products can slide with respect to the contact members. This condition occurs, for example, when (in order to maintain phasing of the contact members for the products and of the area of the flexible member devoid of contact members for the head and tail trimmings) the flexible member is decelerated and the products advance with respect thereto under the push of the pusher therebehind. Similarly, the fixed longitudinal element will also have a low friction coefficient, at least along the edge in contact with the products to be handled. For example, products such as Teflon® or other similar products can be used.

According to a different aspect, the invention relates to a method to eliminate head and tail trimmings from series of aligned products, wherein a series of products is pushed by a pusher between a longitudinal supporting element and a continuous movable flexible member equipped with contact members, the contact members supporting the products which advance between the flexible member and the longitudinal supporting element, the flexible member having a section devoid of contact members at the level of the head and tail trimmings of the series of products to cause said trimmings to fall. Characteristically, the method according to the invention entails: holding the longitudinal supporting element fixed while making said products slide along said supporting element; by means of variation in the speed of the flexible member, causing acceleration of at least the last product of each series to distance said product from said pusher.

The invention also relates to a method to eliminate head and tail trimmings from series of aligned products, wherein a series of products is pushed by a pusher between a longitudinal supporting element and a continuous movable flexible member equipped with contact members, said contact members being in contact with the products advancing between said flexible member and said longitudinal supporting element, said flexible member having a section devoid of contact members at the level of the head and tail trimmings of said series of products to cause said trimmings to fall. Characteristically, said flexible member is controlled at a variable speed to carry the section thereof devoid of contact members each time to the level of the head and tail trimmings of two consecutive series of products, also with the flexible member having a length which is less than the length of the series of products.

Further advantageous characteristics and embodiments of the device and of the method according to the invention are indicated in the appended claims and shall be described in greater detail hereunder with reference to an example of embodiment of the invention.

BRIEF DESCRIPTION OF THE DRAWINGS

The invention shall now be better understood by following the description and accompanying drawing showing a non-limiting practical embodiment of the invention. More specifically, in the drawing.

DETAILED DESCRIPTION OF THE PREFERRED EMBODIMENT OF THE INVENTION

Figure 3:
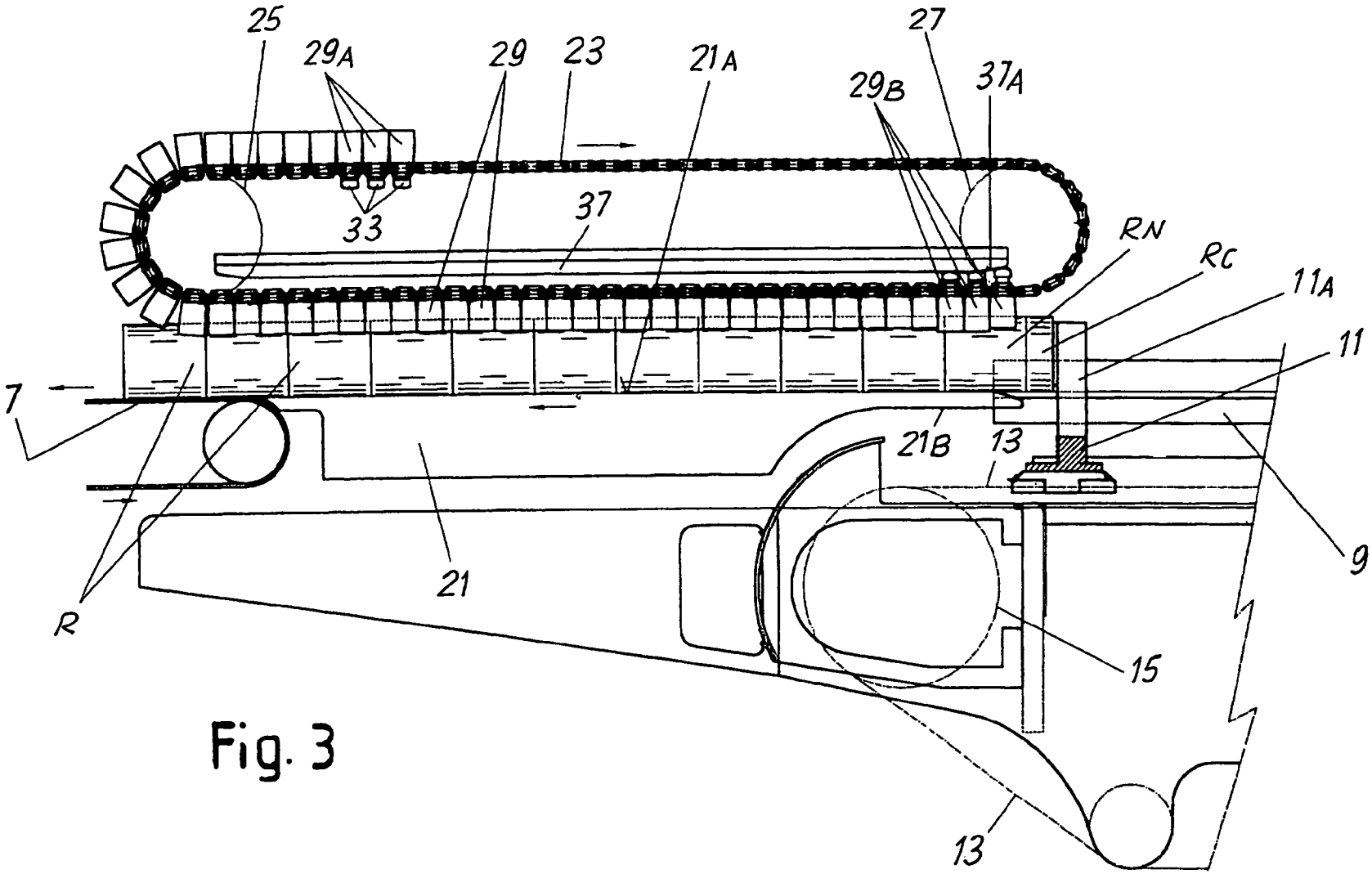
Figure 4:
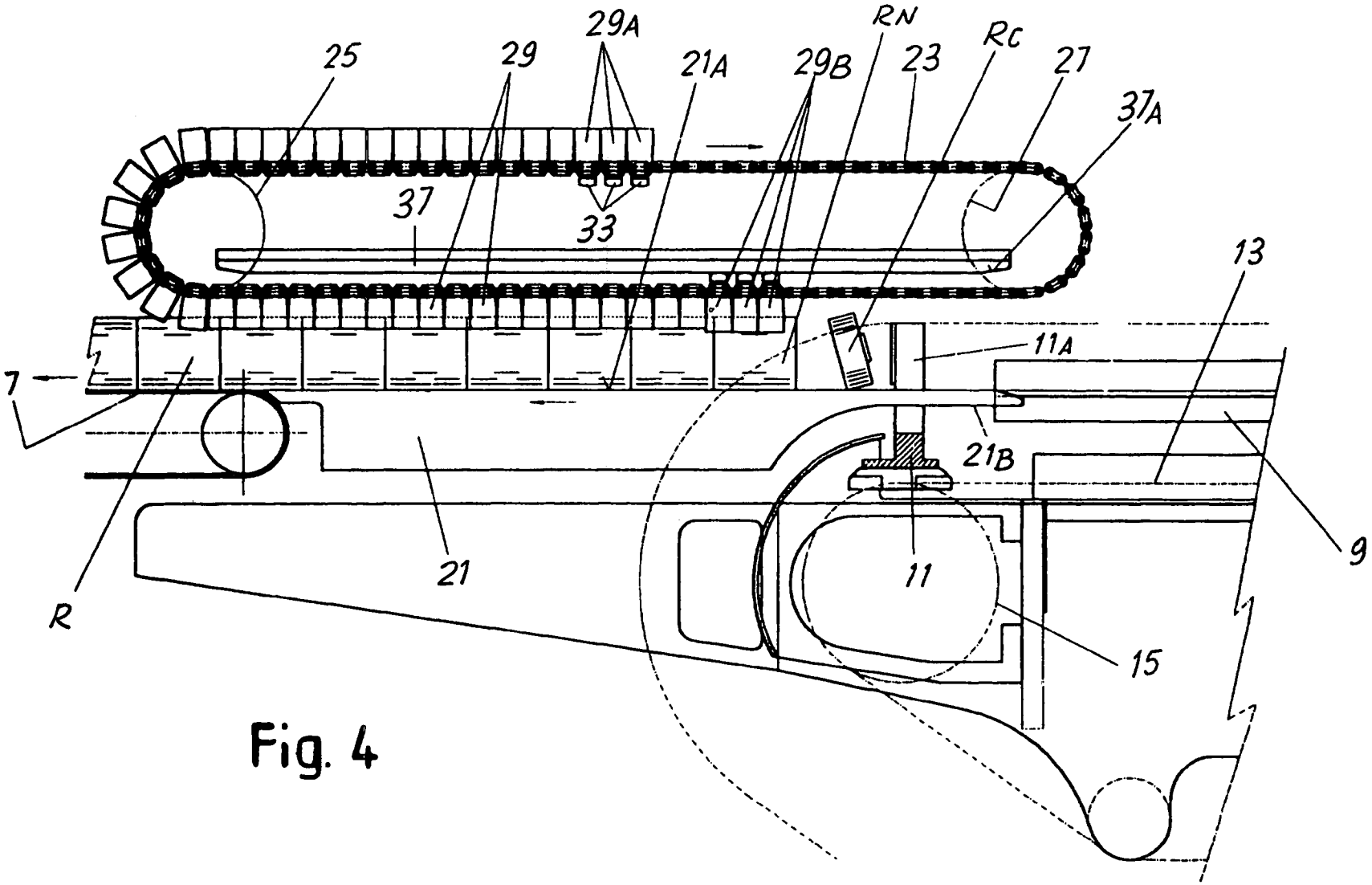
Figure 5:
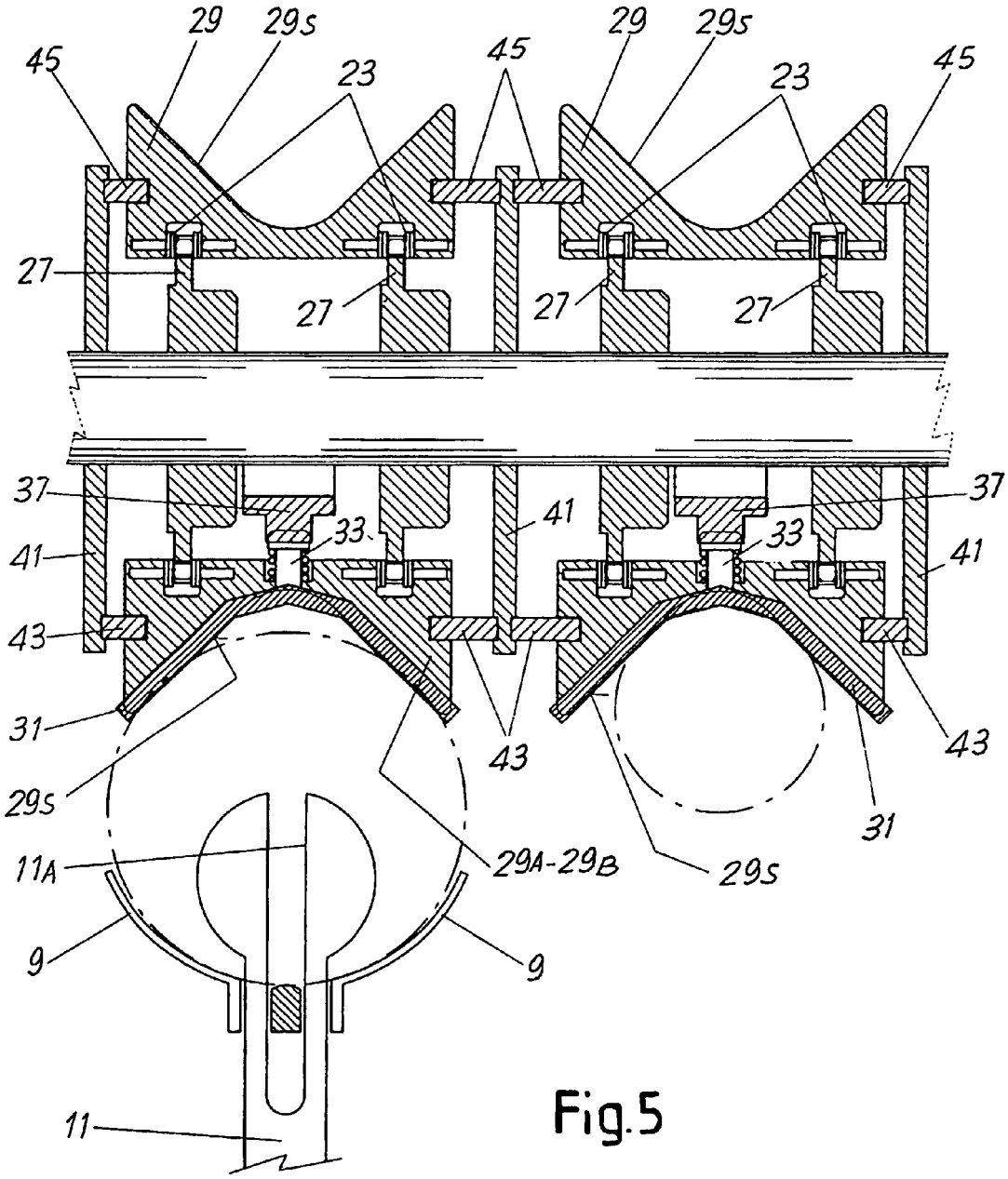
FIG. 5 shows a section according to V-V in FIG. 1.

With initial reference specifically to the schematic side views in FIGS. 1 to 4 and to the section in FIG. 5, the device, indicated as a whole with 1, is positioned downstream of a cutting machine 3 represented only schematically and comprising an circular knife T or other equivalent cutting member, such as a band saw, to divide logs L of a considerable length into series of rolls R of a length the same as the length of the finished product. The cutting machine 3 also produces for each log a head trimming Rt and a tail trimming Rc, which must be eliminated from the device 1, while the rolls R must be transferred to a conveyor 7 which then transfers them towards packaging machines of a known type and not shown. Cutting machines of this type are known and shall not be described herein.

The cutting machine 3 may have one or more channels. The example illustrated shows only two adjacent channels (FIG. 5), along which logs and therefore series of rolls in parallel, cut simultaneously by the cutting machine 3, advance. The arrangement of a variable number of channels is known to those skilled in the art and does not require particular descriptions. Hereunder, reference shall normally be made to one channel, it being understood that each channel has similar members to eliminate trimmings and to make the logs and cut rolls advance. Especially when a high number of adjacent channels are provided, the position of the pushers and of the logs along the various channels can be phased (in a known way) to optimize the position with respect to the movement of the blade T of the cutting machine.

The rolls R produced by cutting each log L by means of the cutting machine 3 advance along a guide 9 under the push of a respective pusher 11 connected to a chain 13 or other suitable flexible member. Several pushers are fixed to the chain 13 in suitable positions, according to a known layout. These are also used to make the logs advance through the cutting machine. The chain 13 is driven about return wheels, one of which can be seen in FIGS. 1 to 4 and indicated with 15. This wheel is motorized by a motor indicated schematically with 17, interfaced with a control unit 19. Both the motor 17 and the control unit 19 are only shown in FIG. 1 for clearer and simpler representation.

Disposed between the chain 13 and the delivery conveyor 7 is a fixed longitudinal supporting element 21, having a laminar configuration, arranged according to a vertical plane. It has a rounded upper edge 21A along which the rolls R slide, being made to advance, in the manner described below, towards the conveyor 7. The element 21 is shaped at the end facing the cutting machine 3 to have a thinner portion 21B, destined to penetrate a slot or slit 11A produced in the pusher 11, as can be seen in particular in FIG. 5. This allows the pusher 11 to advance along the trajectory thereof which turns about the axis of the return wheel 15, said axis being positioned under the element 21. The longitudinal supporting element 21 could also have the shape of a bar, for example with a circular section, mounted cantilevered, so that the end thereof facing the cutting machine 3 can penetrate the slot 11A provided on the pusher 11 and allow the pusher to travel along the trajectory thereof.

Extending above the fixed longitudinal supporting element 21 and essentially aligned vertically therewith, is a flexible member 23, in the example shown formed of a pair of chains driven about a pair of toothed return wheels 25, 27. The toothed wheels 27 are motorized by a motor indicated schematically with 28 in FIG. 1, interfaced with the central unit 19. The motor 28, just as the motor 17, is an electronically controlled variable speed motor, for the purposes to be explained hereunder.

Figure 6:
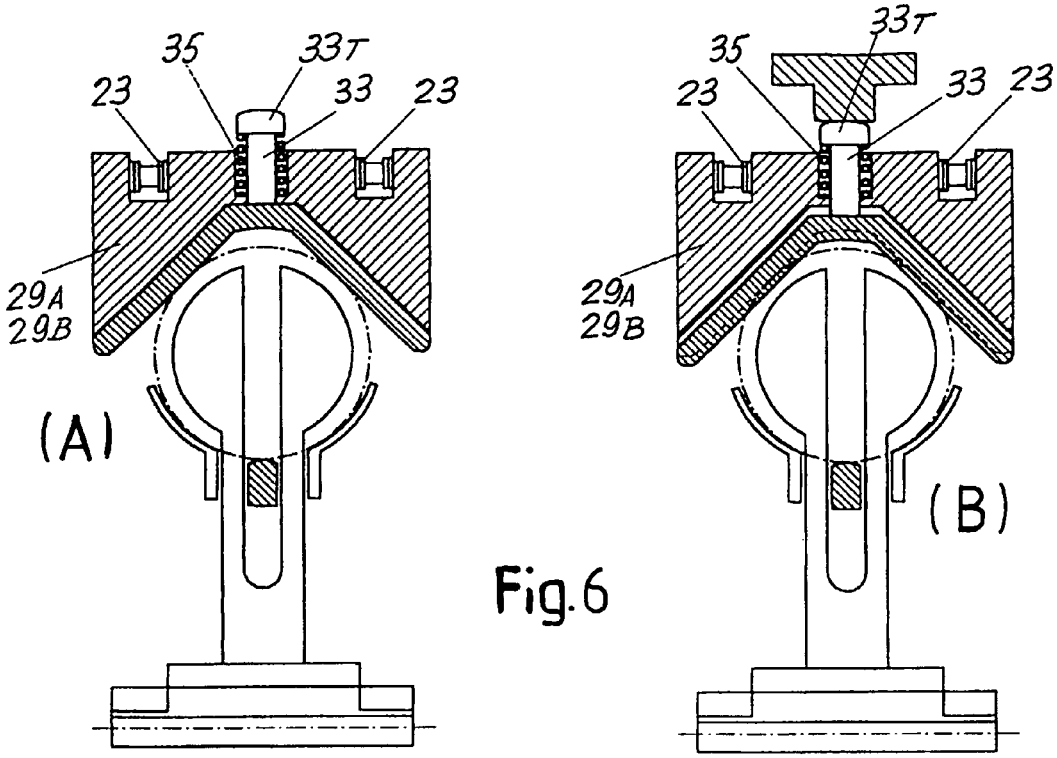
FIGS. 6A and 6B schematically show a front view of a contact member which can be operated to grasp the roll, in two different positions.
Figure 7:
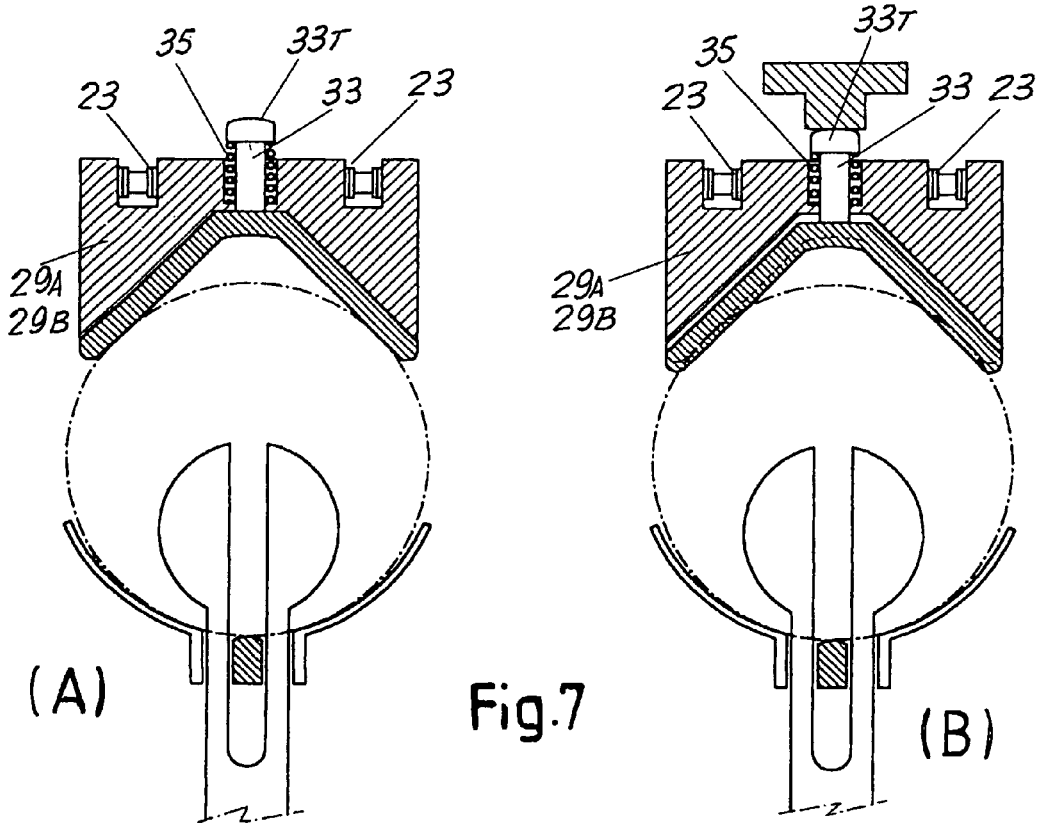
FIGS. 7A and 7B show the same members in FIGS. 6A and 6B operating with rolls with a larger diameter.
Figure 8:
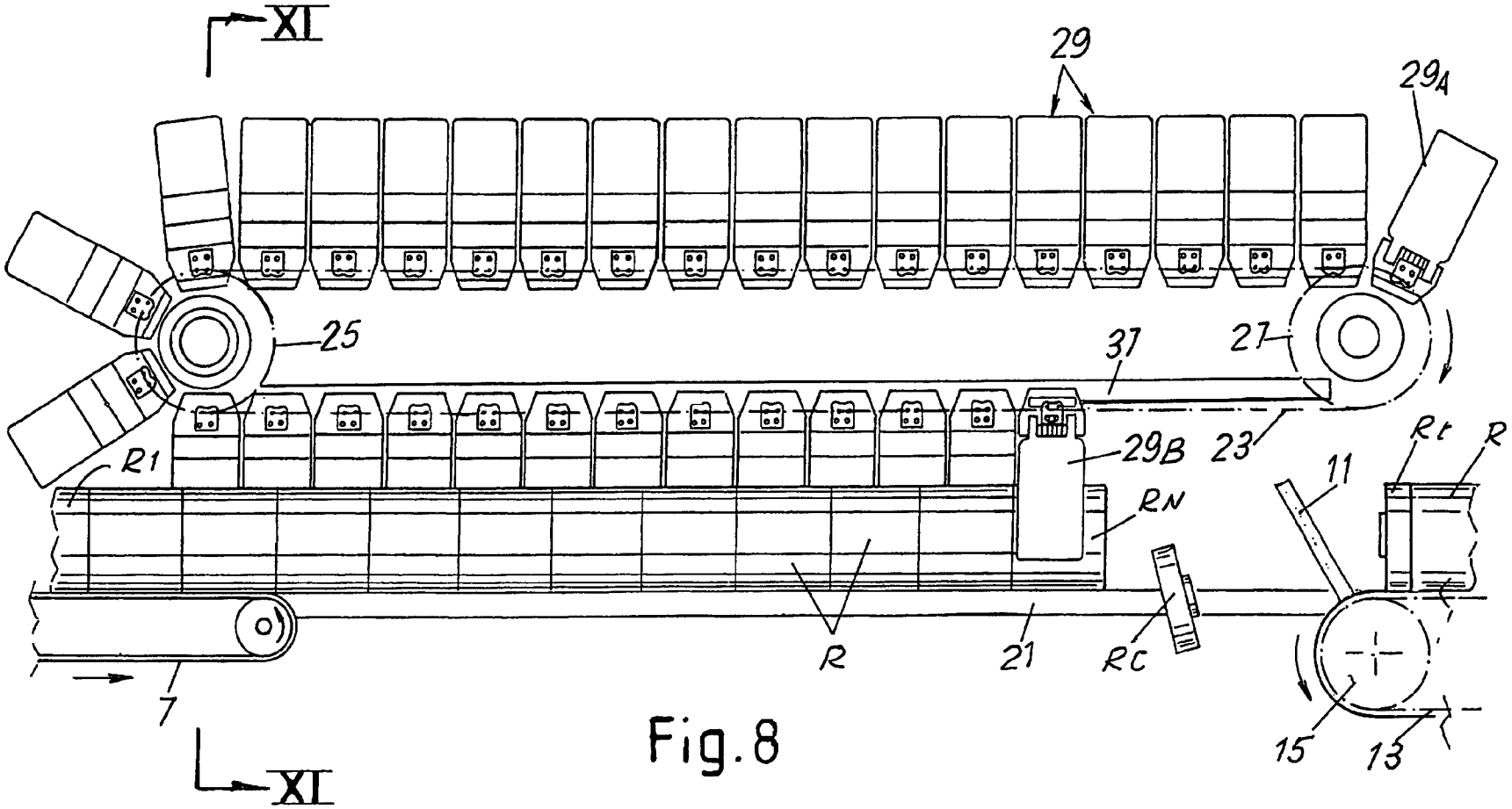
FIG. 8 shows as schematic side view of a different embodiment of the invention.

Disposed along a portion of the flexible member 23 are a series of contact members 29, adjacent to one another, destined to form a support for the rolls R made to advance in the device 1. As can be seen in particular in FIGS. 5 to 7, all the members, with the exception of the three initial members 29A and the three final members 29B are composed of simple V-shaped bodies, where the V-shaped surface, indicated with 29S is destined to come into contact with the upper surface of the rolls R.

The members 29A and the members 29B, which constitute the end members of the series of contact members carried by the flexible member 23, delimit a section or portion of the flexible member 23 which is devoid of said contact members. This section devoid of contact members 29, 29A, 29B is phased with respect to the position of the pushers and of the head and tail trimmings Rt and Rc, so that the trimmings of each series of rolls are always positioned at the level of the section devoid of contact members 29, 29A, 29B.

Each of the end contact members 29A, 29B is equipped with a movable portion or element, constituted by a bracket 31, also V-shaped, made of or coated with a material with a high friction coefficient, which may also be deformable, such as rubber or the like. This bracket is normally housed in a groove produced in the surface 29S. Each of said brackets is integral with a pin 33 projecting from the opposite side of the flexible member 23. A helical compression spring 35 is associated with each pin 33 to react against a shoulder produced in a through seat formed in the member 29A or 29B and against a boss defined by a head 33T of said pin 33. In substance, the helical spring 35 forces the bracket 31 to remain retracted in the seat produced in the V-shaped surface 29S, without projecting therefrom.

Disposed along at least a portion of the lower branch of the flexible member 23 is a fixed control profile 37, with respective inclined end portions, forming cam profiles. This control profile acts on the heads 33T of the pins 33 when they pass under the profile and produce a thrust thereon which causes the respective brackets 31 to project from the seats thereof for the purposes explained hereunder.

Figures 1, 1A:
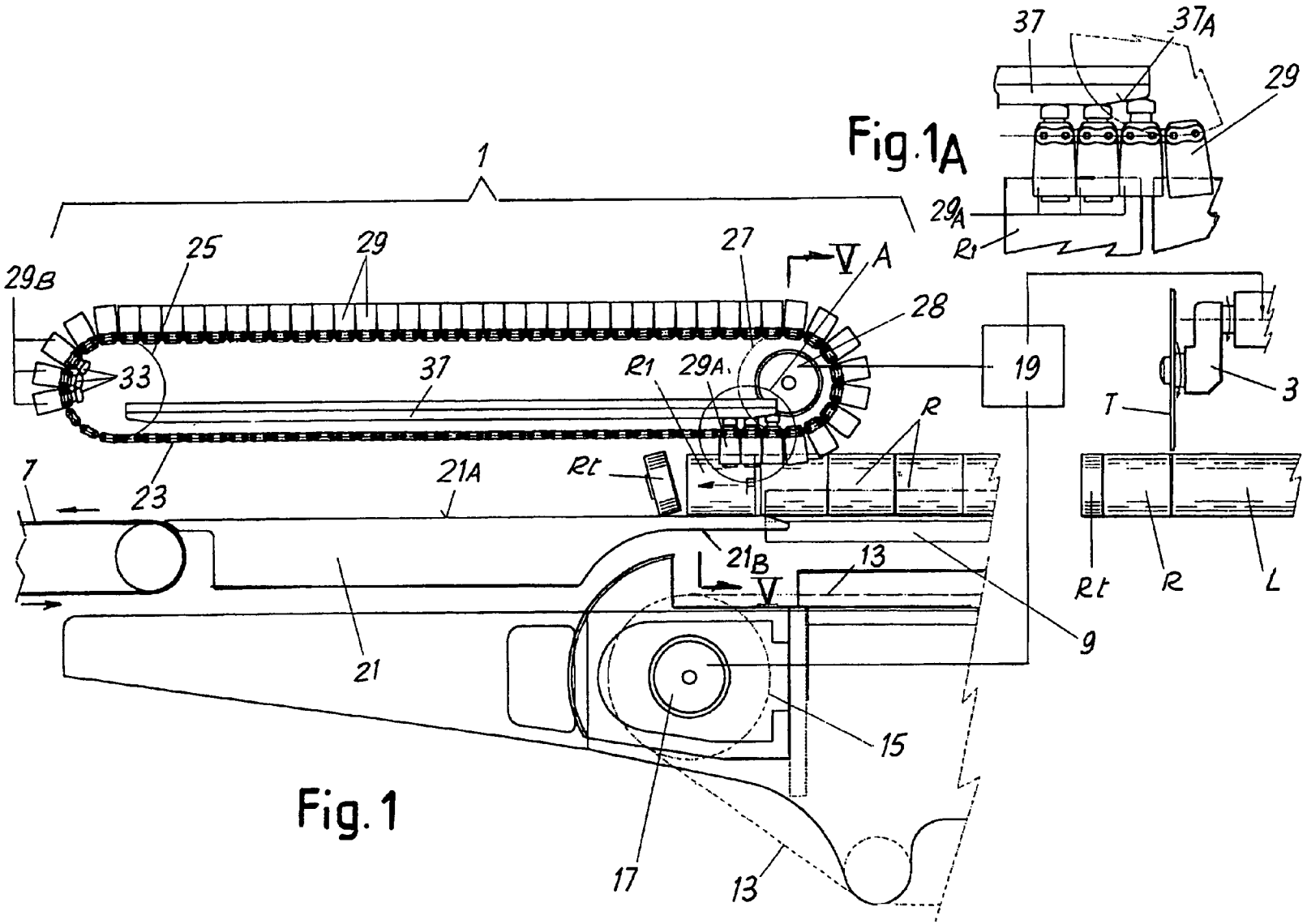
FIGS. 1 to 4 show, in schematic side views, the device in four separate operating phases, FIG. 1A being an enlargement of the detail A in FIG. 1.

The device described above operates as follows. FIG. 1 shows the instant in which the first roll R1 of the series of rolls pushed by the pusher 11 comes into contact with the lower fixed longitudinal supporting element 21 and with the initial contact members 29A carried by the flexible member 23. As can be observed in detail in FIG. 1A, these contact members 29A are made to project downwards by the control profile 37. In this way the roll R1 is gripped firmly by the members 29A and more particularly by the brackets 31 thereof. This allows the flexible member 23 to accelerate even suddenly to ensure that the roll R1 is drawn forward according to the arrow F. In fact, in FIG. 1 the roll R1 is shown slightly detached from the subsequent roll, representing the fact that this roll has been accelerated with respect to the speed imparted thereto and to the subsequent rolls R by the pusher 11 and therefore by the motor 17. In actual fact, acceleration could also be delayed with respect to the instant represented in FIG. 1, for example it could be imparted only after all three contact members 29A have firmly grasped the roll R1. The rolls upstream of the roll R1 could be drawn by the contact members 29 or slide with respect thereto, due to the fact that the surfaces 29S of said members have a low friction coefficient. In the example shown it has been hypothesized that the acceleration imparted by the flexible member 23 only accelerates the first roll R1 grasped by the contact members 29A.

Acceleration of the first roll R1 of the row or series of rolls pushed by the pusher 11 also causes accelerated advance of the head trimming Rt. This is not in contact with any contact member 29, as it is located in the section of flexible member 23 devoid of said members 29. Therefore, as it cannot remain balanced on the upper edge 21A (which is also rounded) of the thin longitudinal element 21, it falls. This produces efficient and reliable removal of the head trimming Rt. It must be noted that elimination is obtained even when the device operates at high speed. To further increase reliability of the device initial acceleration of the roll R1 can be followed by deceleration thereof, to ensure that the support behind of the head trimming Rt is removed. The surfaces 29S of the contact members 29 devoid of brackets 31 carried by the flexible member 23 allow easy relative sliding between these surfaces and the rolls R, so that the members 29 can be made to advance at a different speed (higher or lower) than the speed at which the rolls R advance under the push of the pusher 11.

In practice, the contact members 29 devoid of brackets 31 are disposed, with respect to the rolls R, so that they only graze said rolls, to provide the rolls with support only. This facilitates advance of the rolls R under the push of the pusher without the contact members 29 impeding advance thereof even if the members and the rolls have different speeds. This allows the flexible member 23 carrying the contact members 29 to be decelerated or stopped in a suitable position during the passage of a series of rolls, after the head trimming has been discarded.

Figure 2:
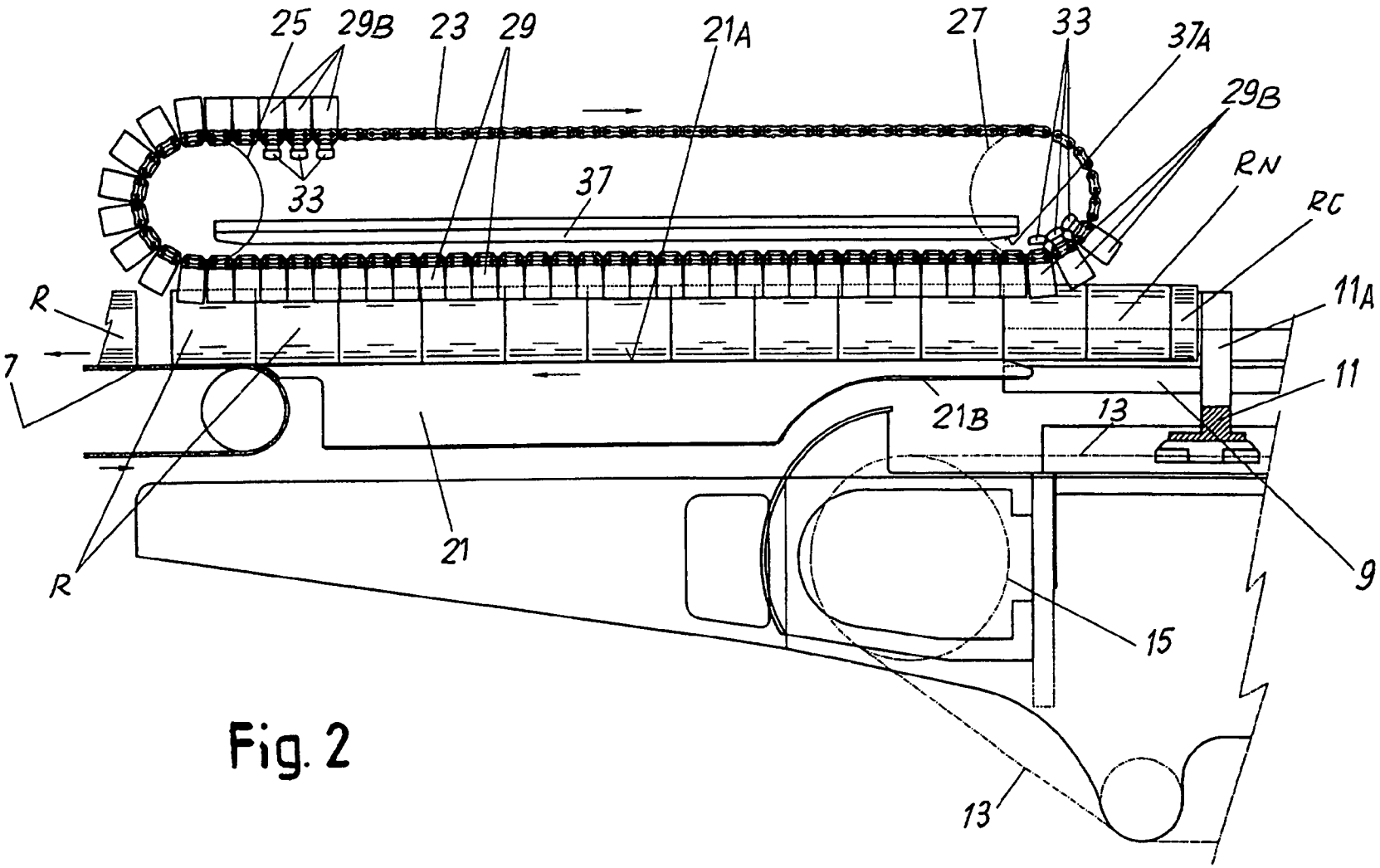

FIG. 2 shows an instant preceding arrival, under the flexible member 23, of the last roll RN and of the tail trimming. Rc of the series of rolls pushed by the pusher 11. In this phase the flexible member 23 can advance at an essentially lower speed than the speed at which the pusher 11 advances. In practice, however, in the layout in FIG. 2, the flexible member 23 could also be steady, while the rolls R, pushed by the pusher 11, are sliding underneath. The contact members 29 in this phase act only as a guide to prevent the rolls, which advance to the conveyor 7, from falling. This conveyor can advance, if need be, at speeds higher than the speed at which the rolls R are fed thereto, to produce reciprocal separation between consecutive rolls.

As can be seen in FIG. 2, the last roll RN is delayed with respect to the position of the last end contact members 29B, so that if the rolls R and the flexible member 23 were to advance in this phase at the same speed, only one of the contact members 29B would grasp the roll RN. In actual fact, as indicated above, the flexible member 23 can be temporarily stopped or made to advance at a lower speed than the speed of the rolls, so that the roll RN recovers space.

An opposite situation can also occur, in which the roll RN is too far advanced with respect to the position of the end contact members 29B. If this occurs these members 29B must not be allowed to grasp the tail trimming Rc. For this purpose the speed can once again be regulated, in this case accelerating the flexible member 23.

FIG. 3 represents the instant in which the last roll RN of the series, that is, the one adjacent to the tail trimming Rc, has been grasped by the three end contact members 29B. The flexible member 23 has been accelerated to the advance speed of the rolls.

To guarantee entirely reliable elimination of the tail trimming Rc, the motor 28 at this point causes temporary acceleration of the flexible member 23 to reach a speed higher than the advance speed of the pusher 11, so that the rolls R, RN are drawn by the contact members 29B and distanced from the tail trimming Rc and from the pusher 11. Also in this case acceleration is guaranteed (as in the case of acceleration of the roll R1) by the fact that the contact members 29B are equipped with brackets 31 which, thrust downwards to press against the roll RN through the effect of the control profile 37, guarantee grasping of said roll. This makes it possible to maintain control on the roll RN and to impart the necessary acceleration thereon (and on the rolls downstream thereof) to distance it from the tail trimming Rc and from the pusher 11. As can be seen in FIG. 4, the tail trimming Rc thereby remains devoid of support and falls to be eliminated. Moreover, the pusher 11 can travel along the trajectory of rotation thereof about the axis of the wheel 15 without impediment and without having to decelerate or stop to distance the last roll Rn of the series.

The pusher 11 continues to advance along the trajectory defined by the chain 13, driven about the return wheel 15 and continues for a certain section to advance parallel to the fixed longitudinal supporting element 21, the tapered portion 21B of which penetrates the slot 11A.

Extension of the profile 37 for the entire length of the lower branch of the flexible member 23 ensures reliable control of the last roll RN which is grasped by the brackets 31, to guarantee that all the rolls are pushed onto the conveyor 7.

FIGS. 6A, 6B and 7A, 7B show how the device can be easily used with rolls even with greatly varying diameters. For this purpose, the flexible member 23 and the relative controls can be disposed on a pair of vertically adjustable side elements 41 (FIG. 5), with a configuration known to those skilled in the art. FIG. 5 again shows rolls with two different diameters, which can be handled by the same device without the need for specific adjustments. It must be understood that in actual fact when the diameter of the roll changes, the side elements 41 with the relative mechanisms supported thereby will move upwards or downwards, while the chain 13 and the sliding channel 9 of the rolls remains at the same height. This facilitates adjustment of the machine.

Also provided on the side elements 41 are fixed guides 43 and 45, which cooperate with lateral grooves of the contact members 29, to prevent the flexible member 23 from jolting along the rectilinear branches.

It is understood from the description above that one of the important aspects of the device consists in the fact that the trimmings are eliminated by being positioned at the level of an area of the flexible member 23 devoid of contact members 29. When the length of the series of rolls R varies, due for example to variation in the width of the ply of paper with which the logs are produced, no adjustments or settings are needed, nor do any components require to be replaced. In fact, only the advance speed of the flexible member 23 must be adjusted. Moreover, the length of the flexible member 23 can be substantially shorter than the series of rolls to be handled, that is, of the logs L. In fact, as observed above, the head and tail trimmings Rt and Rc are eliminated thanks to the absence of contact members 29 in a portion of the flexible member 23. It has also been observed that these contact members have the function of drawing forward only the first roll R1, to accelerate and then decelerate it in order to increase the reliability of elimination of the head trimming Rt. They also have the function of pushing the last rolls when the pusher 11 is no longer in contact therewith.

Advantageously, the member 23 and the contact members 29 can also accelerate the last roll RN to increase reliability of unloading of the tail trimming Rc and to distance the rolls from the pusher 11 allowing it to invert its trajectory without having to decelerate and without interfering with the final roll RN. In the interval between the phases to draw the first and the last roll of each row the flexible member 23 can remain at a standstill, for example in the position in FIG. 2, while the row of rolls R slides under the contact members 29 which in this phase are only used for support. It is therefore possible to produce a very short flexible member 23, even much shorter than the one shown in the accompanying drawing, reducing the section thereof devoid of contact members 29, that is, reducing the distance between the members 29A and the members 29B. Variation in speed of the motor 28 allows the position of the contact members 29A always to be returned in phase with the first roll R1 and the contact members 29B with the last roll RN of each row, and hence the area of the flexible member 23 devoid of contact members 29 to be returned in phase with the position of the tail trimmings Rc of a series of rolls and the head trimmings Rt of the consecutive series.

FIGS. 8 to 12 show a further embodiment of the invention. Similar or corresponding elements are designated with the same reference numbers used in FIGS. 1-7. The cutting machine placed upstream of the trim removal device is not shown.

The rolls R produced by cutting each log L by means of the cutting advance under the push of a respective pusher 11 connected to a chain 13 or other suitable flexible member. Several pushers are fixed to the chain 13 in suitable positions, according to a known layout. These are also used to make the logs advance through the cutting machine. The chain 13 is driven about return wheels 15. This wheel is motorized by a motor equivalent to motor 17, interfaced with a control unit equivalent to unit 19. Both the motor 17 and the control unit 19 are not shown in FIG. 8 for clearer and simpler representation.

Figure 9:
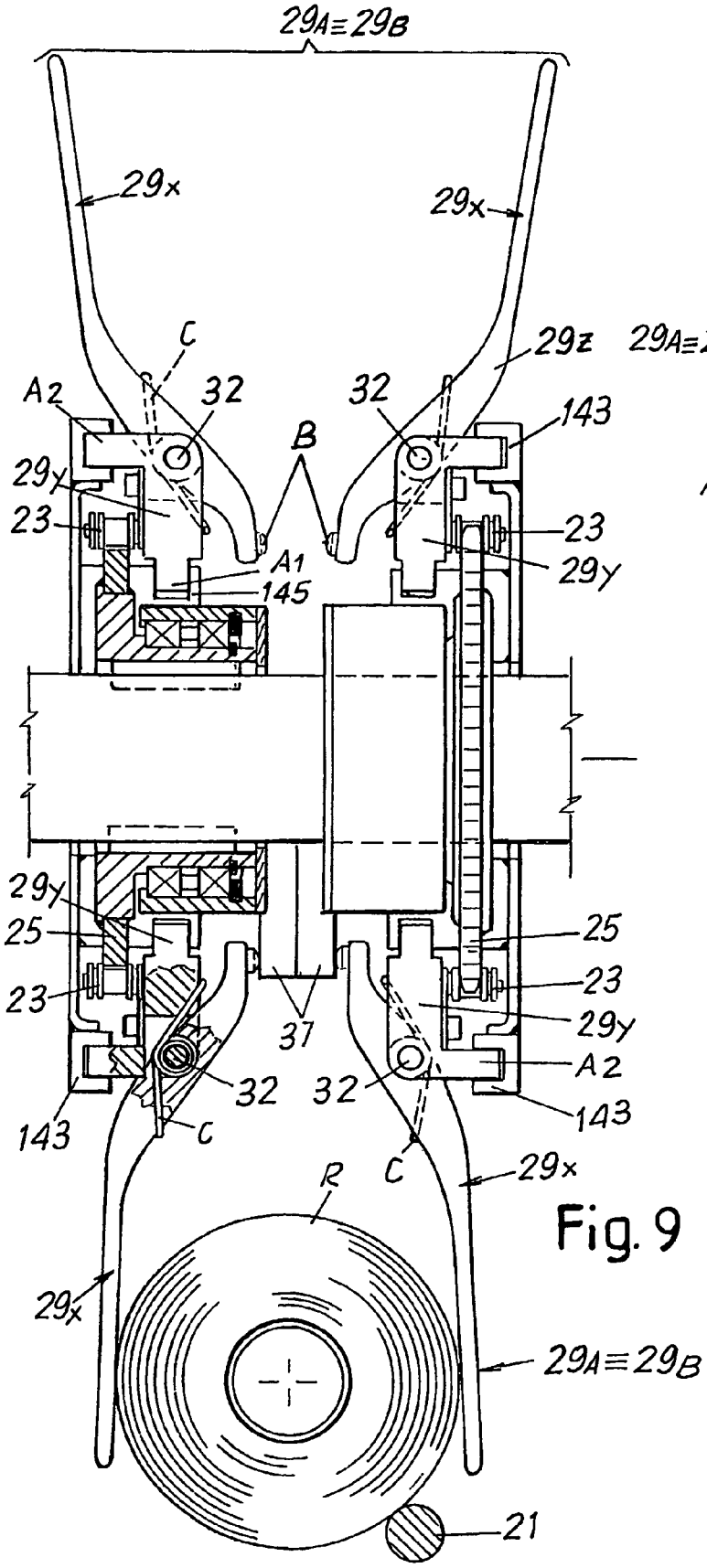
FIG. 9 shows a cross section of one of the return wheels around which the flexible member is entrained, showing contact members having a gripping action.

Disposed between the chain 13 and the delivery conveyor 7 is a fixed longitudinal supporting element 21, in the form of a bar having circular cross section (see in particular FIG. 9). The rolls R slide along the supporting element 21 towards the conveyor 7.

Extending above the fixed longitudinal supporting element 21 is a flexible member 23, in the example shown formed of a pair of chains driven about a pair of toothed return wheels 25, 27. The toothed wheels 27 are motorized by an electronically controlled, variable speed motor, not shown, similar to motor 28 in FIG. 1, interfaced with the central unit 19, just as the motor 17.

Figure 11:
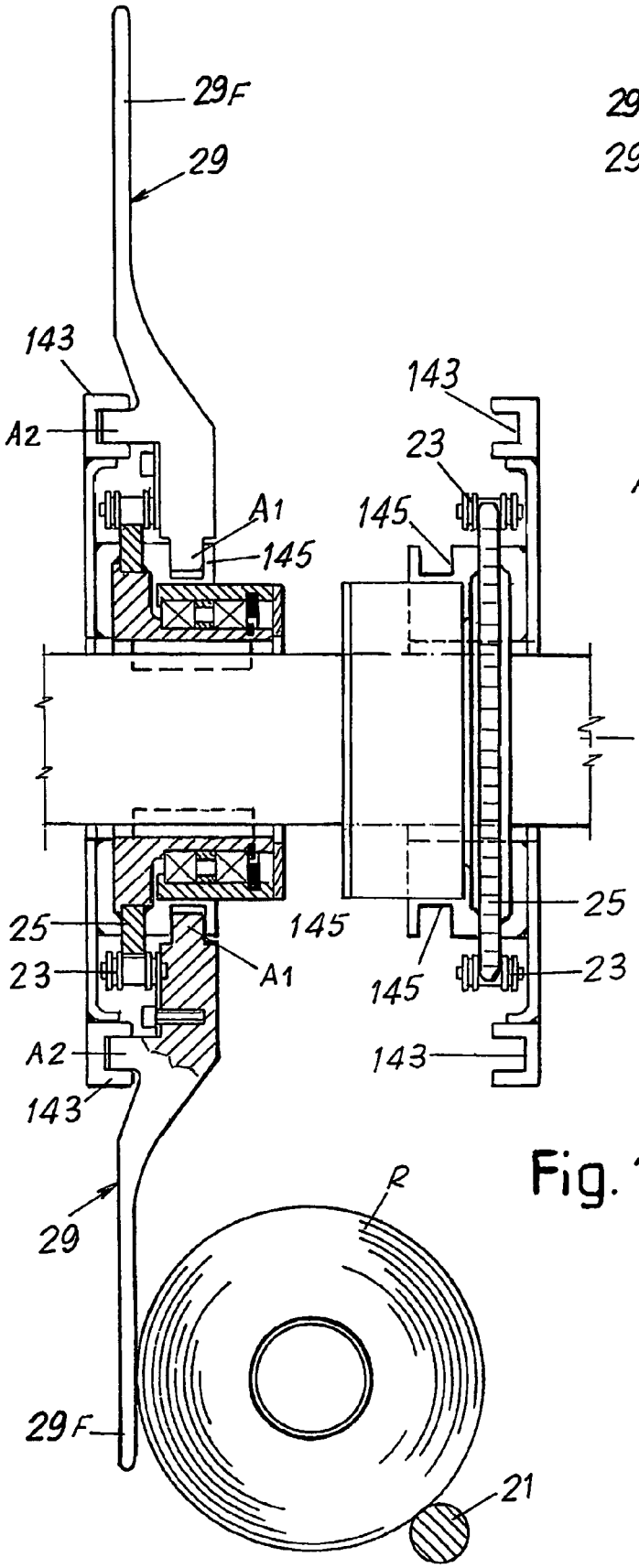
FIG. 11 shows a cross section similar to FIG. 9, along line XI-XI of FIG. 8.
Figure 12:
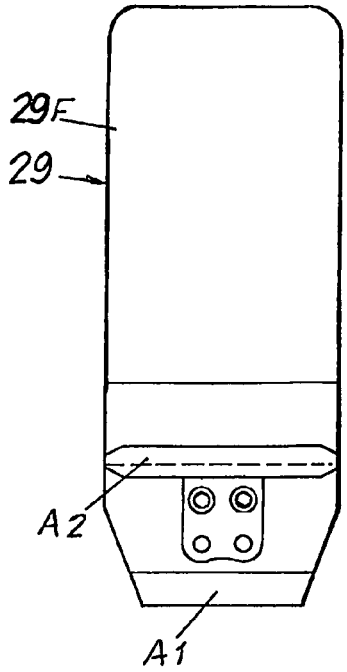
FIG. 12 shows a side view of one of the contact members in isolation.

In this embodiment the chains forming the flexible member 23 are not vertically aligned above the supporting element 21. Rather, as can be seen in FIGS. 9 and 11, the flexible member is laterally staggered with respect to the supporting element 21 such that the latter is placed on a side of the vertical plane of symmetry of the flexible member 23, i.e. the geometrical plane with respect to which the chains 23 are symmetrically arranged. The arrangement is such that the pusher 11 can pass on the side of the supporting element 21, the pusher being symmetrically disposed with respect to the two chains 23. In this way the pusher 11 does not require to be slotted as shown in 11A in the previous figures.

Disposed along a portion of the flexible member 23 are a series of contact members 29, adjacent to one another, providing a lateral support for the rolls R made to advance in the device 1. As can be seen in particular in FIGS. 11 and 12, all the contact members, with the exception of the initial member 29A and the final member 29B are composed of simple flat bodies, having a substantially vertically extending finger portion, indicated with 29F designed to come into contact with the side surface of the rolls R. As can be seen in FIG. 11, each roll contacts the vertical finger 29F and the support element 21 in two points arranged such that the roll does not fall down, but is supported by said two mechanical elements. Actually, each roll can be supported on one side by more than just one contact element 29, as can be appreciated from FIG. 8.

Each contact member 29 is provided with two projections or appendages A1 and A2 engaging into guiding channels 143 and 145 supported by a frame, not shown.

As can be seen in the cross-section of FIG. 11, the contact elements 29 are provided only on one of the two chains 23, while the other chain is free of said contact elements 29. More specifically, the chain which is provided with contact elements 29 is the one which is farther away from the supporting element 21. This is due to the fact that each roll R has to lean on the contact elements 29 on the side opposite the supporting element 21.

The members 29A and the members 29B, which constitute the end members of the series of contact members carried by the flexible member 23, delimit a section or portion of the flexible member 23 which is devoid of said contact members. This section devoid of contact members 29, 29A, 29B is phased with respect to the position of a pusher 11 and of the tail trimming and head trimming Rc and Rt of two subsequent series of rolls R, so that the trimmings of each series of rolls are always positioned at the level of the section devoid of contact members 29, 29A, 29B.

Figure 10:
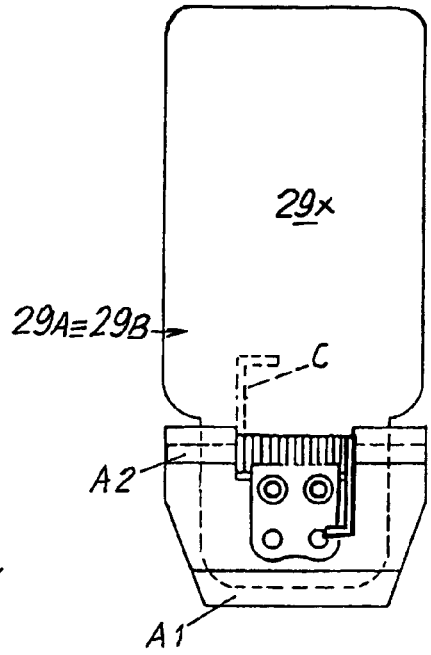
FIG. 10 shows a side view of one of the contact members having a gripping action in isolation.

As best seen in FIGS. 9 and 10, each contact member 29A, 29B is shaped in the form of a gripper including a pair of jaws 29X. Each jaw 29X includes a slider 29Y and a shoe 29Z hinged at 32 to the respective slider. Helical springs C keep the shoes 29Z in an open position (see upper pair of shoes in FIG. 9). Each shoe 29Z is further provided with projections B, which are forced by the springs C in a position of minimum distance (see again upper pair of shoes in FIG. 9).

Each slider is provided with two appendages, again designated A1, and A2, engaging in the sliding guides 143, 145 respectively and having substantially the same shape as the appendages A1, A2 of the contacting members 29 (FIGS. 11 and 12) arranged between members 29A and 29B.

Disposed along at least a portion of the lower branch of the flexible member 23 is a fixed control profile 37, with respective inclined end portions, forming cam profiles. This control profile acts on the protrusions B of each shoe 29X of the contact members 29A and 29B when they pass under and along said profile 37 and produce a thrust thereon which causes the respective shoes 29X to oscillate around pivot points 32 against the action of springs C. This causes the roll R arranged between the shoes 29X to be grasped by said shoes. Each of the two terminal contact members 29A, 29B act, therefore, quite in the same manner as forceps or pliers to grasp the roll R which is located between the shoes.

The device shown in FIGS. 8 to 12 operate quite in the same way as the device of FIGS. 1-7. However, the first roll R1 and the last roll RN of each row or series of rolls is not grasped by way of a pushing force exerted by the terminal contact members 29A, 29B. Rather they are grasped laterally by the forceps formed by each pair of shoes 29X of said terminal contact members 29A, 29B. The first and last roll of each row is thus firmly and safely grasped but is not damaged, since it is not pushed against a fixed surface along which it is caused to slide. The force with which each roll R1, R, RN leans on the longitudinal supporting element 21 is due only to the own weight of the roll.

Acceleration, deceleration, stopping and any speed variation and synchronization of the upper flexible member 23 is essentially the same and for the same purposes as described above with respect to FIGS. 1-7, such that a detailed description of the dynamic behavior of the device can be dispensed with.

It is understood that the drawing purely shows a possible embodiment of the invention, which may vary in forms and arrangements without however departing from the scope of the inventive concept. Any reference numerals in the appended claims are provided for the sole purpose of facilitating reading in the light of the description hereinbefore and the attached drawings and do not in any manner limit the scope of protection.

The invention claimed is:

1. A device to eliminate trimmings or scraps from series of products comprising an input member for the products; an output member for the products; at least one continuous movable upper flexible member carrying a series of contact members for the products aligned with one another, a section of said movable upper flexible member being devoid of said contact members to allow trimmings to fall; at least one stationary longitudinal lower supporting element of the products, parallel to said movable upper flexible member and bridging said input member and said output member, an essentially aligned position of said flexible member and of said longitudinal lower supporting element being such that the products advance in contact with and supported during elimination of said trimmings (1) by the contact members of the flexible member and (2) by the longitudinal lower supporting element to said output member; at least one pusher to insert the series of products with respective trimmings between said flexible member and said longitudinal lower supporting element; wherein said flexible member is controlled with a cyclically variable speed to carry the section thereof devoid of contact members every time to a level of tail and head trimmings of two consecutive series of products.

2. Device as claimed in claim 1, wherein said continuous flexible member has at least one second contact member designed to grasp at least a first product of each series and make the first product advance.

3. Device as claimed in claim 1, wherein at least some of the contact members are provided with a contact surface for the products having a low friction coefficient, to allow said products to slide with respect to said at least one longitudinal supporting element.

4. Device as claimed in claim 1, wherein said flexible member is controlled at a variable speed to accelerate at least a last product of each series with respect to the pusher therebehind.

5. Device as claimed in claim 1, wherein said flexible member is controlled at a variable speed to accelerate and, optionally, subsequently decelerate, at least a first product of each series with respect to a subsequent product.

6. Device as claimed in claim 1, wherein said flexible member is controlled to advance at a lower speed or to stop during an interval of time between arrival of a first product and arrival of a last product of each series, during said interval of time the products being pushed by said pusher and sliding along the flexible member resting on the contact members.

7. Device as claimed in claim 1 or 2, wherein one or more of said contact members disposed at each end of the series of contact members carried by said flexible member, adjacent to said portion of the flexible member devoid of contact members, can be operated to have a grasping effect on the products in contact therewith.

8. Device as claimed in claim 1 or 2, wherein said contact members designed to grasp said products are mounted movable, with respect to the flexible member which carries the contact members, at least in a direction essentially orthogonal to said flexible member.

9. Device as claimed in claim 1 or 2, wherein the contact members designed to grasp the products have a movable portion.

10. Device as claimed in claim 9, wherein a fixed control profile acts on said movable portions, an elastic element being provided to hold each of said movable portions in contact with said fixed control profile.

11. Device as claimed in claim 1, wherein said flexible member is laterally staggered with respect to said longitudinal supporting element.

12. Device as claimed in claim 1, wherein said flexible member is controlled to be accelerated synchronously with a position of said pusher, to distance a last product of each series from the pusher therebehind.

13. Device as claimed in claim 1, wherein said flexible member is controlled to be accelerated synchronously with a position of said pusher, to distance a first product of each series at least temporarily from a subsequent product.

14. Device as claimed in claim 1, wherein said flexible member includes a pair of parallel chains, one of said chains being provided with a plurality of intermediate contact members, said intermediate contact members being arranged in a laterally staggered position with respect to said longitudinal supporting element.

15. Device as claimed in claim 1, wherein said first contact member designed to grasp at least the last product of each series of products includes two shoes and means are provided to control a grasping motion of said shoes.

16. Device as claimed in claim 2, wherein said second contact member designed to grasp at least the first product of each series of products includes two shoes and means are provided to control a grasping motion of said shoes.

17. Device as claimed in claim 15, wherein the two shoes of said first contact member are controlled by a fixed cam profile, which controls a closing motion of said shoes.

18. Device according to claim 15, wherein said flexible member includes a pair of parallel chains, one of said chains being provided with a plurality of intermediate contact members, said intermediate contact members being arranged in a laterally staggered position with respect to said longitudinal supporting element and wherein each shoe of said first contact member is carried by a respective one of said chains.

19. Device as claimed in claim 2, wherein at least one of said first contact member or said second contact member designed to grasp said products includes jaws- or pliers-shaped grasping members.

20. Device as claimed in claim 1, wherein said at least one pusher has a slot in which the longitudinal supporting element penetrates when said pusher pushes the products between the longitudinal supporting element and the flexible member.

21. Device as claimed in claim 1, wherein said products are rolls obtained from cutting a log.

22. Device according to claim 16, wherein said flexible member includes a pair of parallel chains, one of said chains being provided with a plurality of intermediate contact members, said intermediate contact members being arranged in a laterally staggered position with respect to said longitudinal supporting element and wherein each shoe of said second contact member is carried by a respective one of said chains.

23. A device to eliminate trimmings or scraps from series of products comprising an input member for the products; an output member for the products; at least one continuous movable upper flexible member carrying a series of contact members for the products aligned with one another, a section of said movable upper flexible member being devoid of said contact members to allow trimmings to fall; at least one stationary longitudinal lower supporting element of the products, parallel to said movable upper flexible member and bridging said input member and said output member, an essentially aligned position of said flexible member and of said longitudinal lower supporting element being such that the products advance in contact with and supported during elimination of said trimmings (1) by the contact members of the flexible member and (2) by the longitudinal lower supporting element to said output member; at least one pusher to insert the series of products with respective trimmings between said flexible member and said longitudinal lower supporting element; wherein said flexible member is controlled with a cyclically variable speed to carry the section thereof devoid of contact members every time to a level of tail and head trimmings of two consecutive series of products; and wherein at least one of said contact members is constructed and arranged to cyclically mechanically grip and release at least a last product of said series of products.

24. Device according to claim 23, wherein said at least one of said contact members is structured to cyclically co-act with an activation member to mechanically grip and release said at least a last product of said series of products.

25. A device to eliminate trimmings or scraps from series of products comprising at least one continuous movable upper flexible member carrying a series of contact members for the products aligned with one another, a section of said movable upper flexible member being devoid of said contact members to allow trimmings to fall; at least one stationary longitudinal lower supporting element of the products, parallel to said movable upper flexible member, an essentially aligned position of said flexible member and of said longitudinal lower supporting element being such that the products advance in contact with and supported during elimination of said trimmings (1) by the contact members of the flexible member and (2) by the longitudinal lower supporting element to an output member; at least one pusher to insert the series of products with respective trimmings between said flexible member and said longitudinal lower supporting element; wherein said flexible member is controlled with a cyclically variable speed such that every time a new series of products is introduced into the device said section of said flexible member devoid of contact members is caused to be phased with positioning of tail and head trimmings of two consecutive series of products.

26. A device to eliminate trimmings or scraps from series of products comprising at least one continuous movable upper flexible member carrying a series of contact members for the products aligned with one another, a section of said movable upper flexible member being devoid of said contact members to allow trimmings to fall; at least one stationary longitudinal lower supporting element of the products, parallel to said movable flexible member, an essentially aligned position of said flexible member and of said longitudinal lower supporting element being such that the products advance in contact with and supported during elimination of said trimmings (1) by the contact members of the flexible member and (2) by the longitudinal lower supporting element to an output member; at least one pusher to insert the series of products with respective trimmings between said flexible member and said longitudinal lower supporting element; wherein said flexible member is controlled with a cyclically variable speed such that every time a new series of products is introduced into the device said section of said flexible member devoid of contact members is caused to be phased with positioning of tail and head trimmings of two consecutive series of products; and wherein at least one of said contact members is constructed and arranged to cyclically mechanically grip and release at least a last product of said series of products.

27. A device to eliminate trimmings or scraps from series of products comprising an input member for the products; an output member for the products; at least one continuous movable upper flexible member carrying a series of contact members for the products aligned with one another, a section of said movable upper flexible member being devoid of said contact members to allow trimmings to fall; at least one longitudinal stationary lower supporting element of the products, parallel to said movable upper flexible member and bridging said input member and said output member, an essentially aligned position of said flexible member and of said longitudinal lower supporting element being such that the products advance in contact with and supported (1) by the contact members of the flexible member and (2) by the longitudinal lower supporting element to an output member; at least one pusher to insert the series of products with respective trimmings between said flexible member and said longitudinal lower supporting element; wherein said flexible member is controlled with a cyclically variable speed to carry the section thereof devoid of contact members every time to a level of tail and head trimmings of two consecutive series of products.

28. A device according to claim 1, 23, 25, 26 or 27, wherein each contact member of said series of contact members is structured to press against an underlying product in said series of products, and said device further includes a control device for selectively accelerating and decelerating said flexible member and thereby said contact members.

29. A device to eliminate trimmings or scraps from series of products comprising an input member for the products; an output member for the products; at least one continuous movable upper flexible member carrying a series of contact members for the products aligned with one another, a section of said movable upper flexible member being devoid of said contact members to allow trimmings to fall, said movable upper flexible member having a leading contact member structured to grip at least a first product of each series of products and advance the first product from the input member to the output member, said leading contact member being adjacent to said series of contact members; a control device in relation to said movable upper flexible member which controls said leading contact member; at least one stationary longitudinal lower supporting element of the products positioned parallel to said movable upper flexible member and bridging said input member and said output member, said movable upper flexible member and said stationary longitudinal lower supporting element being essentially aligned such that the series of products advance in contact with and supported during elimination of said trimmings (1) by the contact members of the flexible member and (2) by the longitudinal lower supporting element; at least one pusher to insert the series of products with respective trimmings between said flexible member and said longitudinal lower supporting element and towards said output member; wherein said flexible member is controlled with a cyclically variable speed to carry the section thereof devoid of contact members every time to a level of tail and head trimmings of two consecutive series of products which said upper flexible member contacts.

30. Device as claimed in claim 29, further comprising a trailing contact member structured to grip at least a last product of each of said series of products, wherein said series of contact members are arranged between said leading contact member and said trailing contact member, and said section of the movable upper flexible member devoid of contact members is present between said trailing contact member and said leading contact member, wherein said control device also controls said trailing contact member.

* * * * *

UNITED STATES PATENT AND TRADEMARK OFFICE

CERTIFICATE OF CORRECTION

PATENT NO. : 7,946,205 B2
APPLICATION NO. : 10/541874
DATED : May 24, 2011
INVENTOR(S) : Benvenuti et al.

It is certified that error appears in the above-identified patent and that said Letters Patent is hereby corrected as shown below:

Title Page:
Insert the following item -

-- (30) Foreign Application Priority Data

Dec. 12, 2003 (IT) . . . . . FI2003A000318 --

Signed and Sealed this
Twelfth Day of June, 2012

David J. Kappos

David J. Kappos
*Director of the United States Patent and Trademark Office*